US011655721B2

(12) United States Patent
Cavagnaro et al.

(10) Patent No.: US 11,655,721 B2
(45) Date of Patent: May 23, 2023

(54) TURBOCHARGER INCLUDING A SEALING ASSEMBLY

(71) Applicant: BorgWarner Inc., Auburn Hills, MI (US)

(72) Inventors: Augustine Cavagnaro, Flat Rock, NC (US); Donald Michael Kennedy, Asheville, NC (US); Erwin Perry Ellwood, III, Candler, NC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 17/083,446

(22) Filed: Oct. 29, 2020

(65) Prior Publication Data

US 2022/0136399 A1 May 5, 2022

(51) Int. Cl.
*F01D 11/00* (2006.01)
*F01D 25/16* (2006.01)

(52) U.S. Cl.
CPC ..... *F01D 11/003* (2013.01); *F01D 25/162* (2013.01); *F05D 2220/40* (2013.01); *F05D 2240/54* (2013.01); *F05D 2240/55* (2013.01)

(58) Field of Classification Search
CPC ..... F01D 25/16; F01D 25/24; F01D 25/162; F01D 11/003; F01D 11/005; F05D 2240/55
See application file for complete search history.

(56) References Cited

U.S. PATENT DOCUMENTS 2,432,684 A 12/1947 Roshong
2,824,759 A 2/1958 Tracy
3,026,114 A 3/1962 Andresen et al.
(Continued)

FOREIGN PATENT DOCUMENTS

CH 685514 A5 7/1995
CN 202493299 U 10/2012
DE 112011100573 T5 11/2012

OTHER PUBLICATIONS

English language abstract and machine-assisted English translation for CN 202493299 extracted from espacenet.com database on Nov. 9, 2020, 5 pages.

(Continued)

*Primary Examiner* — Topaz L. Elliott
*Assistant Examiner* — Cameron A Corday
(74) *Attorney, Agent, or Firm* — Howard & Howard Attorneys PLLC

(57) ABSTRACT

A turbocharger includes a shaft extending between first and second shaft ends. A turbine wheel is coupled to the first shaft end, and a bearing housing defines a bearing housing interior and is disposed about the shaft. A turbine housing defines a turbine housing interior and is disposed about the turbine wheel. A sealing assembly includes a case disposed about the shaft and extending between a first case end proximate to the turbine wheel and a second case end distal from the turbine wheel. The sealing assembly also includes a ring disposed between the shaft and the case such that the ring is unobstructed by the case radially between the shaft and the ring. The sealing assembly further includes a deformable component coupled to the second case end and to the ring, and is moveable with the ring to seal the bearing housing interior and the turbine housing interior.

20 Claims, 8 Drawing Sheets

(56) References Cited

U.S. PATENT DOCUMENTS 3,106,381 A 10/1963 Leins
3,109,658 A 11/1963 Barrett et al.
3,258,199 A * 6/1966 Anderson ..... F16J 15/38 277/362
3,479,040 A 11/1969 Tracy
3,495,840 A 2/1970 Wilk
3,498,620 A 3/1970 Wiese
3,526,408 A 9/1970 Tracy
3,608,910 A * 9/1971 Tyler ..... F16J 15/38 415/174.3
3,652,183 A * 3/1972 Pottharst, Jr. ..... F16J 15/348 415/111
3,675,935 A 7/1972 Ludwig et al.
3,843,140 A 10/1974 Mayer et al.
3,921,986 A 11/1975 Geary et al.
4,103,907 A 8/1978 Inouye et al.
4,114,899 A 9/1978 Kulzer et al.
4,145,059 A 3/1979 Imai et al.
4,304,408 A * 12/1981 Greenawalt ..... F16J 15/348 277/925
4,586,717 A 5/1986 Sweeney
4,725,206 A 2/1988 Glaser et al.
4,749,199 A 6/1988 Gresh
4,943,069 A 7/1990 Jinnouchi
5,039,115 A 8/1991 Hebert et al.
5,145,189 A 9/1992 Pope
5,301,957 A 4/1994 Hwang et al.
5,468,002 A 11/1995 Wasser
5,496,047 A 3/1996 Goldswain et al.
5,909,878 A 6/1999 Schrufer et al.
5,938,205 A 8/1999 Azibert et al.
6,322,081 B1 * 11/2001 Ullah ..... F16C 33/76 277/504
6,325,380 B1 * 12/2001 Feigl ..... F16J 15/3404 277/400
6,341,781 B1 * 1/2002 Matz ..... F16J 15/363 277/944
6,565,095 B2 5/2003 Meacham
6,761,359 B2 7/2004 Azibert
6,943,468 B2 9/2005 Iida et al.
7,334,799 B2 2/2008 O'Hara
7,789,636 B2 * 9/2010 Liebl ..... F01D 25/183 417/407
7,946,118 B2 5/2011 Hippen et al.
8,202,042 B2 6/2012 Petitjean et al.
8,833,053 B2 9/2014 Chir et al.
9,169,738 B2 10/2015 Schlienger et al.
9,328,692 B2 5/2016 Rado et al.
9,353,647 B2 5/2016 Bordne et al.
9,366,264 B2 6/2016 Parker
9,447,753 B2 9/2016 Kuribayashi et al.
9,500,119 B2 11/2016 Lischer
9,695,708 B2 7/2017 Hettinger et al.
9,784,109 B2 10/2017 Laengler
9,850,857 B2 12/2017 Rexavier et al.
10,036,346 B2 7/2018 Maki et al.
10,087,780 B2 10/2018 John et al.
10,087,821 B2 10/2018 Oakes et al.
10,087,939 B2 10/2018 Eckl
11,187,326 B2 11/2021 Moriya et al.
2012/0321450 A1 12/2012 Aschenbruck et al.
2017/0248032 A1 8/2017 Williams et al.
2018/0135698 A1 5/2018 Toyota
2018/0283269 A1 10/2018 Wu et al.
2018/0355752 A1 12/2018 Shioya et al.
2020/0325908 A1 * 10/2020 Chandramohanan ..... F04D 29/0563

OTHER PUBLICATIONS

English language abstract and machine-assisted English translation for CH 685 514 A5 extracted from espacenet.com database on Jun. 29, 2022, 9 pages.
English language abstract for DE 11 2011 100 573 T5 extracted from espacenet com database on Jun. 29, 2022, 2 pages.

* cited by examiner

TURBOCHARGER INCLUDING A SEALING ASSEMBLY

BACKGROUND OF THE INVENTION

1. Field of the Invention

The present invention generally relates to a turbocharger including a sealing assembly.

2. Description of the Related Art

Turbochargers receive exhaust gas from an internal combustion engine of a vehicle and deliver compressed air to the internal combustion engine. Turbochargers are used to increase power output of the internal combustion engine, decrease fuel consumption of the internal combustion engine, and reduce emissions produced by the internal combustion engine. Delivery of compressed air to the internal combustion engine by the turbocharger allows the internal combustion engine to be smaller, yet able to develop the same or similar amount of horsepower as larger, naturally aspirated internal combustion engines. Having a smaller internal combustion engine for use in the vehicle reduces the mass and aerodynamic frontal area of the vehicle, which helps reduce fuel consumption of the internal combustion engine and improve fuel economy of the vehicle.

Typical turbochargers include a shaft extending along an axis between a first shaft end and a second shaft end. Turbochargers further include a turbine wheel coupled to the first shaft end of the shaft, and a compressor wheel coupled to the second shaft end of the shaft. The turbine wheel and the compressor wheel are rotatable with the shaft. Specifically, the exhaust gas from the internal combustion engine, which would normally contain wasted energy, is used to drive the turbine wheel, which is used to drive the shaft and, in turn, the compressor wheel to deliver compressed air to the internal combustion engine. Typical turbochargers also include a bearing housing defining a bearing housing interior and disposed about the shaft, and a turbine housing defining a turbine housing interior and disposed about the turbine wheel.

In some turbochargers, a sealing assembly is included for sealing the bearing housing interior and the turbine housing interior. Typically, a lubricant is present in the bearing housing interior, and the sealing assembly limits the lubricant from entering the turbine housing interior. Moreover, the exhaust gas is typically present in the turbine housing interior and contains uncombusted carbon and corrosive by-products of combustion, and the sealing assembly limits the exhaust gas from interacting with the lubricant. However, sealing assemblies known in the art suffer from deficiencies, particularly relating to sealing the high temperature exhaust gases present in the turbine housing interior where the high temperature of the exhaust gas is transferred, particularly by conduction, to the bearing housing interior.

These deficiencies include, but not limited to, blowby of the exhaust gas from the turbine housing interior to the bearing housing interior, and leakage of the lubricant from the bearing housing interior to the turbine housing interior. Both blowby of the exhaust gas and leakage of the lubricant degrade the quality of the lubricant. Sealing assemblies known in the art lack temperature stability to reduce the blowby of the exhaust gas and the leakage of the lubricant, and thus decrease the life, durability, and reliability of the sealing assembly and of the turbocharger. Moreover, sealing assemblies known in the art attempting to address these deficiencies disadvantageously increase an axial length of the turbocharger.

As such, there remains a need to provide an improved sealing assembly for a turbocharger that limits blowby of the exhaust gas from the turbine housing interior to the bearing housing interior and limits leakage of the lubricant from the bearing housing interior to the turbine housing interior.

SUMMARY OF THE INVENTION AND ADVANTAGES

A turbocharger delivers compressed air to an internal combustion engine. The turbocharger includes a shaft extending along an axis between a first shaft end and a second shaft end. A turbine wheel is coupled to the first shaft end of the shaft. A bearing housing is disposed about the shaft, and the bearing housing defines a bearing housing interior. A turbine housing is disposed about the turbine wheel, and the turbine housing defines a turbine housing interior. The turbocharger also includes a sealing assembly for sealing the bearing housing interior and the turbine housing interior.

The sealing assembly includes a case disposed about the shaft. The case extends along the axis between a first case end proximate to the turbine wheel, and a second case end distal from the turbine wheel. The sealing assembly also includes a ring disposed between the shaft and the case such that the ring is unobstructed by the case radially between the shaft and the ring. The sealing assembly further includes a deformable component coupled to the second case end of the case and to the ring. The deformable component is moveable with the ring to seal the bearing housing interior and the turbine housing interior.

A lubricant may be present in the bearing housing interior, and the exhaust gas may be present in the turbine housing interior and may contain uncombusted carbon and corrosive by-products of combustion. The sealing assembly limits the high temperature exhaust gases that may be present in the turbine housing interior from being transferred, particularly by conduction, to the bearing housing interior. The sealing assembly also limits the blowby of the exhaust gas from the turbine housing interior to the bearing housing interior. Furthermore, the sealing assembly limits leakage of the lubricant from the bearing housing interior to the turbine housing interior. Therefore, the sealing assembly limits blowby of the exhaust gas and leakage of the lubricant from degrading the quality of the lubricant by reducing the uncombusted carbon and corrosive by-products of combustion in the exhaust gas from transferring to the lubricant.

More specifically, because the sealing assembly includes a ring disposed between the shaft and the case such that the ring is unobstructed by the case radially between the shaft and the ring, the sealing assembly is thermally stable at the high temperatures present during operation of the turbocharger such that sealing assembly is prevented from thermally degrading (e.g. melting). The ring being unobstructed by the case radially between the shaft and the ring results in the sealing assembly being able to lift-off close to the shaft, thus removing the need for an o-ring in contact with the shaft that is liable to thermally degrade.

Therefore, because the sealing assembly is prevented form thermally degrading, the sealing assembly reduces blowby of the exhaust gas and leakage of the lubricant, thus increasing the life of the sealing assembly and of the turbocharger by maintaining the quality of the lubricant. As such, the sealing assembly improves the durability and reliability of the turbocharger. Moreover, the sealing assembly is able to seal the bearing housing interior and the turbine housing interior without significantly increasing an axial length of the turbocharger.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
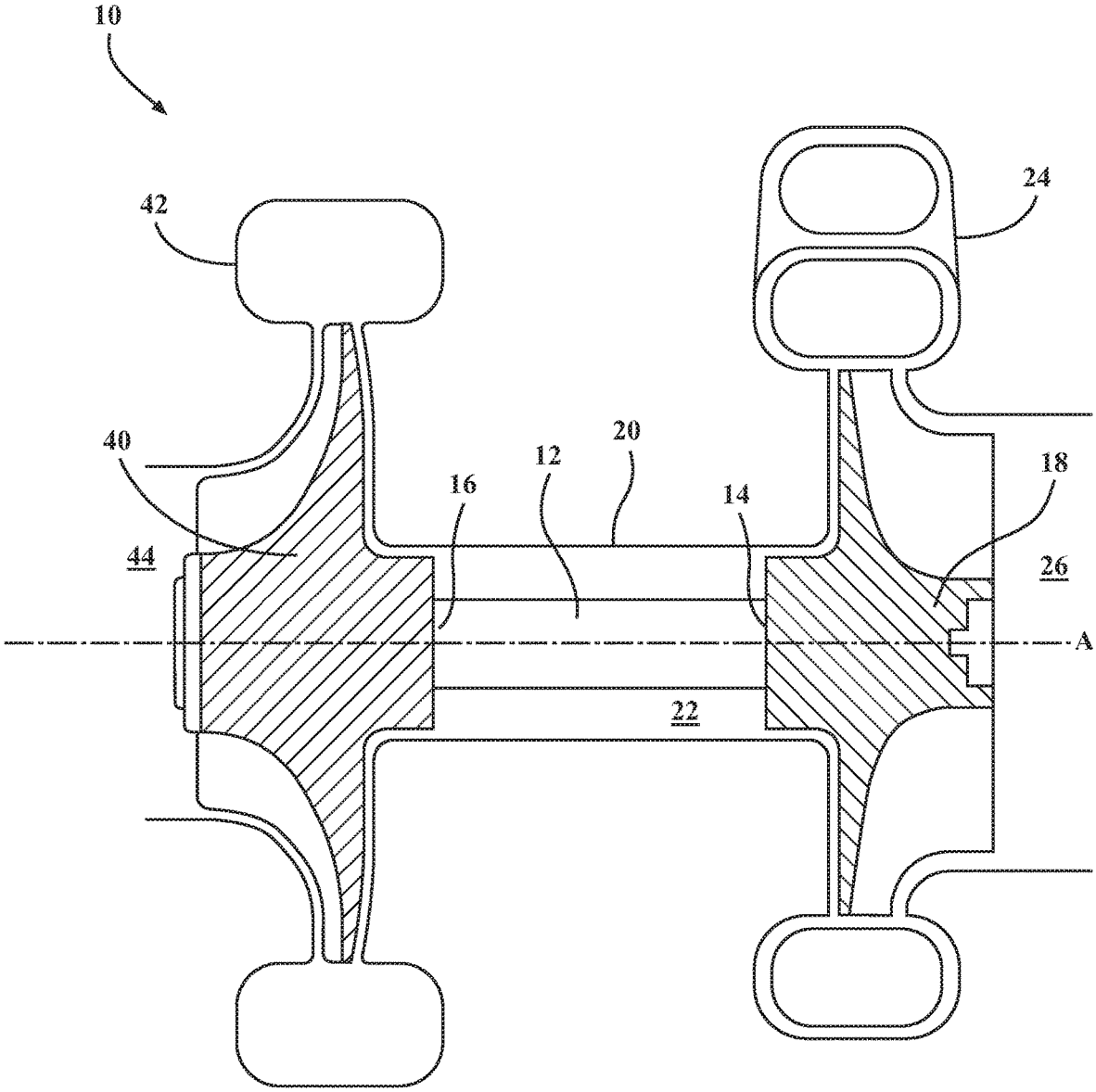
FIG. 1 is a schematic illustration of a turbocharger having shaft extending along an axis between a first shaft end coupled to a turbine wheel and a second shaft end coupled to a compressor wheel, a bearing housing defining a bearing housing interior, and a turbine housing defining a turbine housing interior.

With reference to the Figures, wherein like numerals indicate like parts throughout the several views, a turbocharger 10 is shown schematically in FIG. 1. The turbocharger 10 delivers compressed air to an internal combustion engine. The turbocharger 10 includes a shaft 12 extending along an axis A between a first shaft end 14 and a second shaft end 16. It is to be appreciated that the first and second shaft ends 14, 16 need not be the exact terminuses of the shaft 12. A turbine wheel 18 is coupled to the first shaft end 14 of the shaft 12. A bearing housing 20 is disposed about the shaft 12, and the bearing housing 20 defines a bearing housing interior 22. A turbine housing 24 is disposed about the turbine wheel 18, and the turbine housing 24 defines a turbine housing interior 26.

It is to be appreciated that the turbocharger 10 may also include a compressor wheel 40, and a compressor housing 42 defining a compressor housing interior 44 and disposed about the compressor wheel 40, as shown in FIG. 1. Although not required, it is also to be appreciated that the turbine housing 24 may be a dual volute turbine housing, a twin scroll turbine housing, or a single inlet turbine housing.

The turbocharger 10 also includes a sealing assembly 28 for sealing the bearing housing interior 22 and the turbine housing interior 26. The sealing assembly 28 includes a case 30 disposed about the shaft 12. The case 30 extends along the axis A between a first case end 32 proximate to the turbine wheel 18, and a second case end 34 distal from the turbine wheel 18. It is to be appreciated that the first and second case ends 32, 34 need not be the exact terminuses of the case 30. The sealing assembly 28 also includes a ring 36 disposed between the shaft 12 and the case 30 such that the ring 36 is unobstructed by the case 30 radially between the shaft 12 and the ring 36. In other words, the case 30 is disposed radially between the shaft 12 and the ring 36. As such, the case 30 is open or semi-open. The sealing assembly 28 further includes a deformable component 38 coupled to the second case end 34 of the case 30 and to the ring 36. It is to be appreciated that the deformable component 38 may be freely rotatable relative either to the second case end 34 of the case 30, to the ring 36, or to both the second case end 34 of the case 30 and to the ring 36, while still being coupled to the second case end 34 of the case 30 and to the ring 36. The deformable component 38 is moveable with the ring 36 to seal the bearing housing interior 22 and the turbine housing interior 26.

A lubricant may be present in the bearing housing interior 22, and the exhaust gas may be present in the turbine housing interior 26 and may contain uncombusted carbon and corrosive by-products of combustion. The sealing assembly 28 limits the high temperatures that may be present in the exhaust gases in the turbine housing interior 26 from being transferred, particularly by conduction, to the bearing housing interior 22. The sealing assembly also limits the blowby of the exhaust gas from the turbine housing interior 26 to the bearing housing interior 22. Furthermore, the sealing assembly 28 limits leakage of the lubricant from the bearing housing interior 22 to the turbine housing interior 26. Therefore, the sealing assembly 28 limits blowby of the exhaust gas and leakage of the lubricant from degrading the quality of the lubricant by reducing the uncombusted carbon and corrosive by-products of combustion in the exhaust gas from transferring to the lubricant.

Moreover, the sealing assembly 28 limits blowby of the exhaust gas into a crankcase of the internal combustion engine, which can then be recirculated into an intake system of the internal combustion engine. The lubricant, uncombusted carbon, and corrosive by-products of combustion that may be recirculated into the intake system may deposit themselves on components of the intake system, thus decreasing the performance of the intake system. The components of the intake system include, but are not limited to, the intake manifold of the internal combustion engine, valves of the internal combustion engine, the compressor wheel 40 of the turbocharger 10, the compressor housing interior 44 of the compressor housing 42, or an intercooler.

More specifically, because the sealing assembly 28 includes the ring 36 disposed between the shaft 12 and the case 30 such that the ring 36 is unobstructed by the case 30 radially between the shaft 12 and the ring 36, the sealing assembly 28 is thermally stable at the high temperatures (e.g. about 300 degrees centigrade) present during operation of the turbocharger 10 such that sealing assembly 28 is prevented from thermally degrading (e.g. melting or oxidizing). The ring 36 being unobstructed by the case 30 radially between the shaft 12 and the ring 36 results in the sealing assembly 28 being able to lift-off close to the shaft 12, thus removing the need for an o-ring in contact with the shaft 12 that is liable to thermally degrade.

Therefore, because the sealing assembly 28 is prevented form thermally degrading, the sealing assembly 28 reduces blowby of the exhaust gas and leakage of the lubricant, thus increasing the life of the sealing assembly 28 and of the turbocharger 10 by maintaining the quality of the lubricant. As such, the sealing assembly improves the durability and reliability of the turbocharger and the internal combustion engine. Moreover, the sealing assembly 28 is able to seal the bearing housing interior 22 and the turbine housing interior 26 without significantly increasing an axial length of the turbocharger 10.

In some embodiments, the case 30 at the first case end 32 has a lip 46 extending radially away from the axis A and directly coupled to the bearing housing 20 to prevent the case 30 from moving axially away from the turbine wheel 18. The lip 46 may be spaced from the bearing housing 20 along the axis A such that the lip 46 is disposed between the bearing housing 20 and the turbine wheel 18, as shown in FIGS. 2-6. Said differently, in this embodiment, the bearing housing 20 is not be disposed axially between the lip 46 and the turbine wheel 18 such that the lip 46 is axially unobstructed by the bearing housing 20 between the lip 46 and the turbine wheel 18. Alternatively, the bearing housing 20 may define an aperture into which the lip 46 is disposed such that the lip 46 is obstructed by the bearing housing 20 axially between the lip 46 and the turbine wheel 18. The lip 46 may extend completely about the axis A, or may extend only partially about the axis A. The lip 46 may have multiple sections extending radially away from the axis A that are radially spaced from one another about the axis A.

The lip 46 may have a radial surface 48 facing the bearing housing 20 and contactable with the bearing housing 20 to prevent the case 30 from moving axially away from the turbine wheel 18. The lip 46 may also have an axial surface 50 facing away from the axis A. Although not required, the axial surface 50 may face the bearing housing 20, may face a heat shield, may face an insert, and/or may face an annular ring. In the embodiments where the axial surface 50 of the lip 46 faces the bearing housing 20, a space 52 may be defined between the axial surface 50 of the lip 46 and the bearing housing 20. Although not required, it is also to be appreciated that the lip 46 may be directly coupled to the bearing housing 20 such that the lip 46 is either in direct contact with the bearing housing 20, or such that the lip 46 is fixed spatially relative to the bearing housing 20. In a non-limiting example, the lip 46 may be in contact with the insert or the annular ring, which in turn may be fixed spatially relative to the bearing housing 20.

In some embodiments, the deformable component 38 is configured to bias the ring 36 toward the turbine wheel 18. The deformable component 38 may exert a first force against the second case end 34 of the case 30, and the first force may be exerted away from the turbine wheel 18. However, in the embodiments where the first force is exerted against the second case end 34 of the case 30 and the case 30 has the lip 46, the lip 46 of the case 30 prevents the second case end 34 of the case 30 from moving axially away from the turbine wheel 18. In these embodiments, therefore, the second case end 34 of the case 30 is static, and the deformable component 38 exerts a second force against the ring 36 to bias the ring 36 toward the turbine wheel 18. In the embodiments where the deformable component 38 is configured to bias the ring 36 toward the turbine wheel 18, the deformable component 38 may be a spring. The spring may be, but is not limited to, a conical spring, a wave spring, a coil spring, a compression spring, and/or a disc or Belleville spring.

Moreover, it is also to be appreciated that the case 30 and the bearing housing 20 may be interference fit with one another, and the lip 46 of the case 30 may also be interference fit with the bearing housing 20. In the embodiments where the case 30 is interference fit with the bearing housing 20, the case 30 and lip 46 may be rotationally and axially fixed relative to the bearing housing 20 and may be sealed relative to bearing housing 20.

Figure 2:
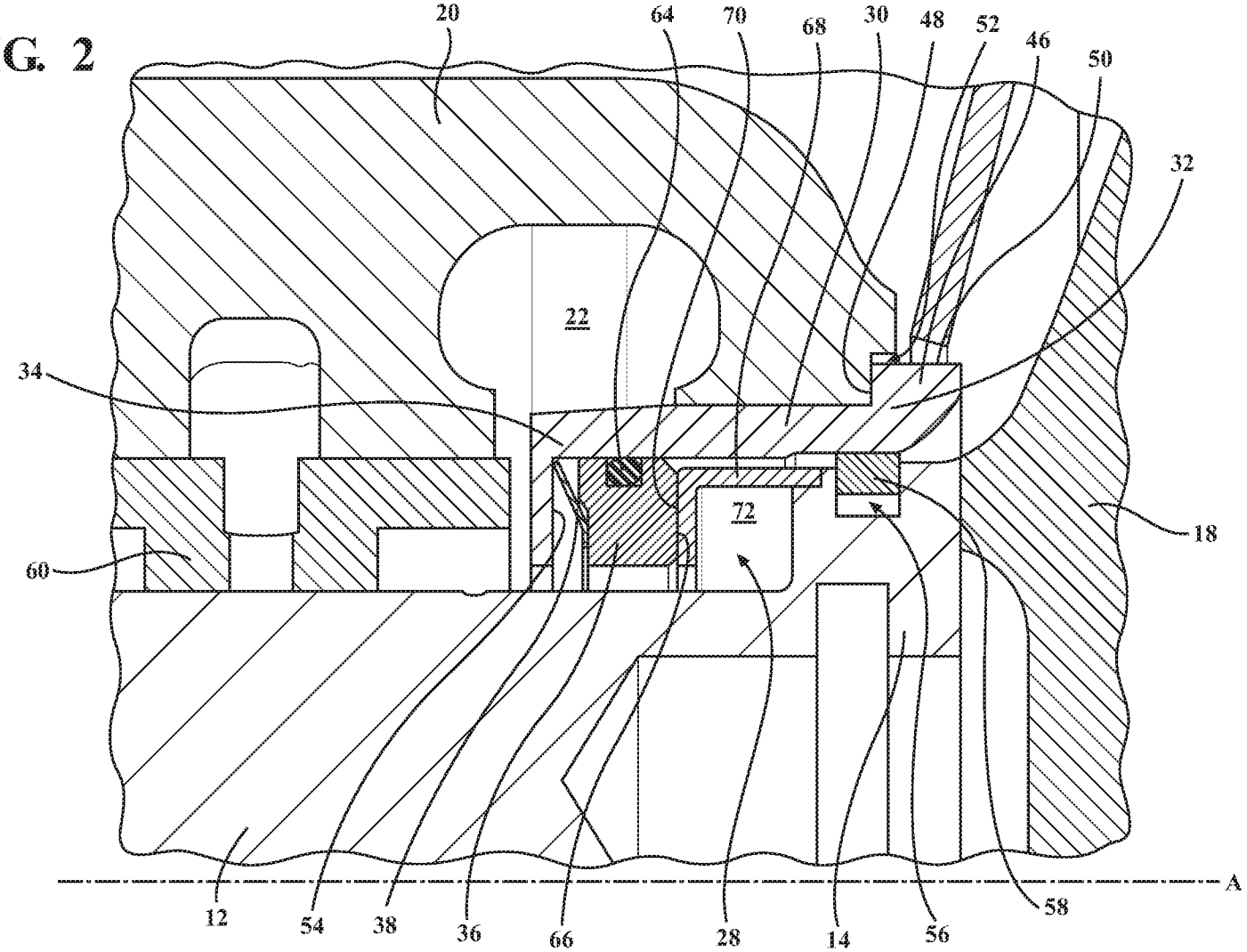
FIG. 2 is a cross-sectional view of the turbocharger, with the turbocharger including a sealing assembly including a case extending between first and second case ends, a deformable component, a ring, and an isolator.
Figure 3:
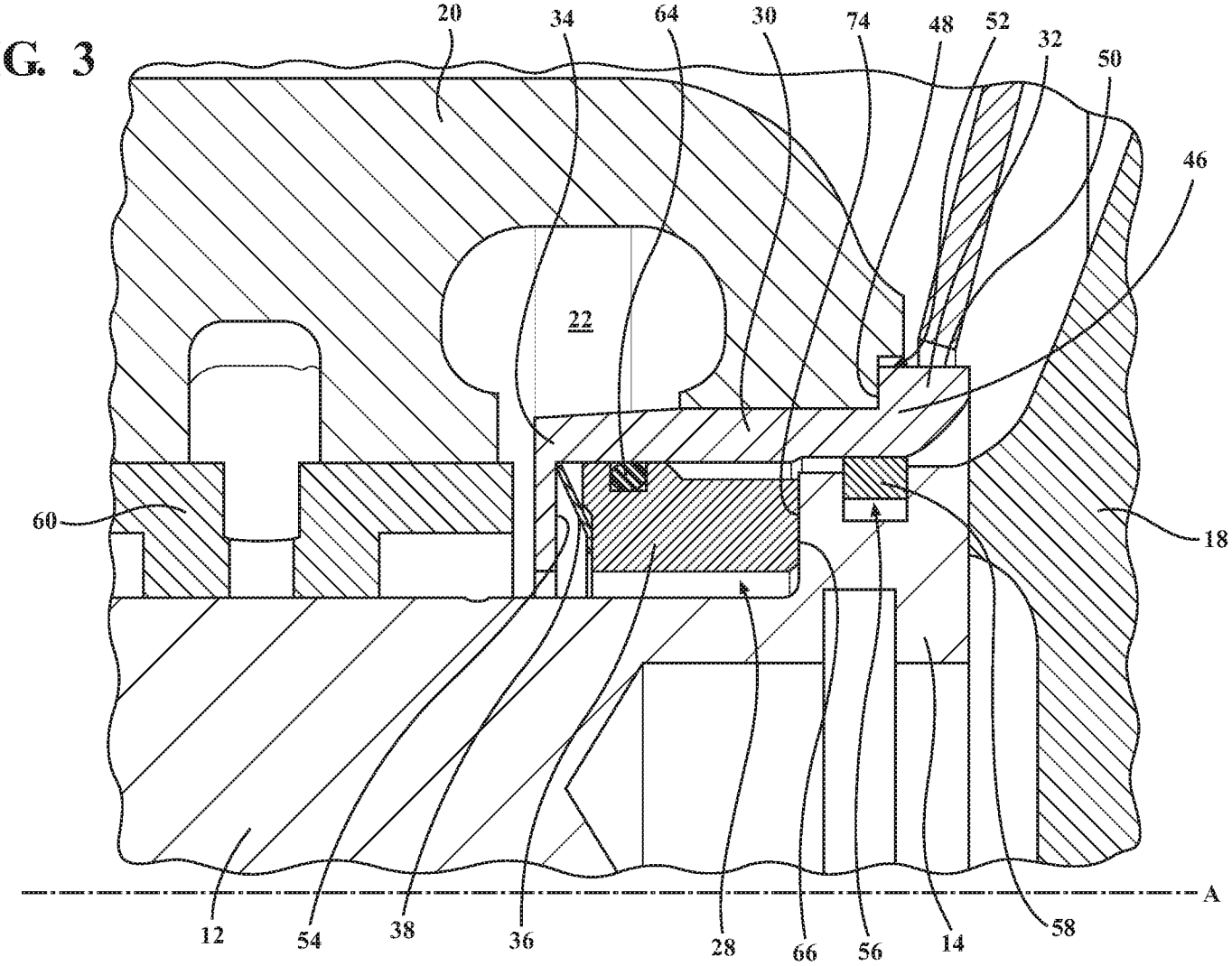
FIG. 3 is a cross-sectional view of the turbocharger, with the sealing assembly including a sealing member, a seating groove, and a piston ring disposed at least partially in the seating groove.
Figure 6:
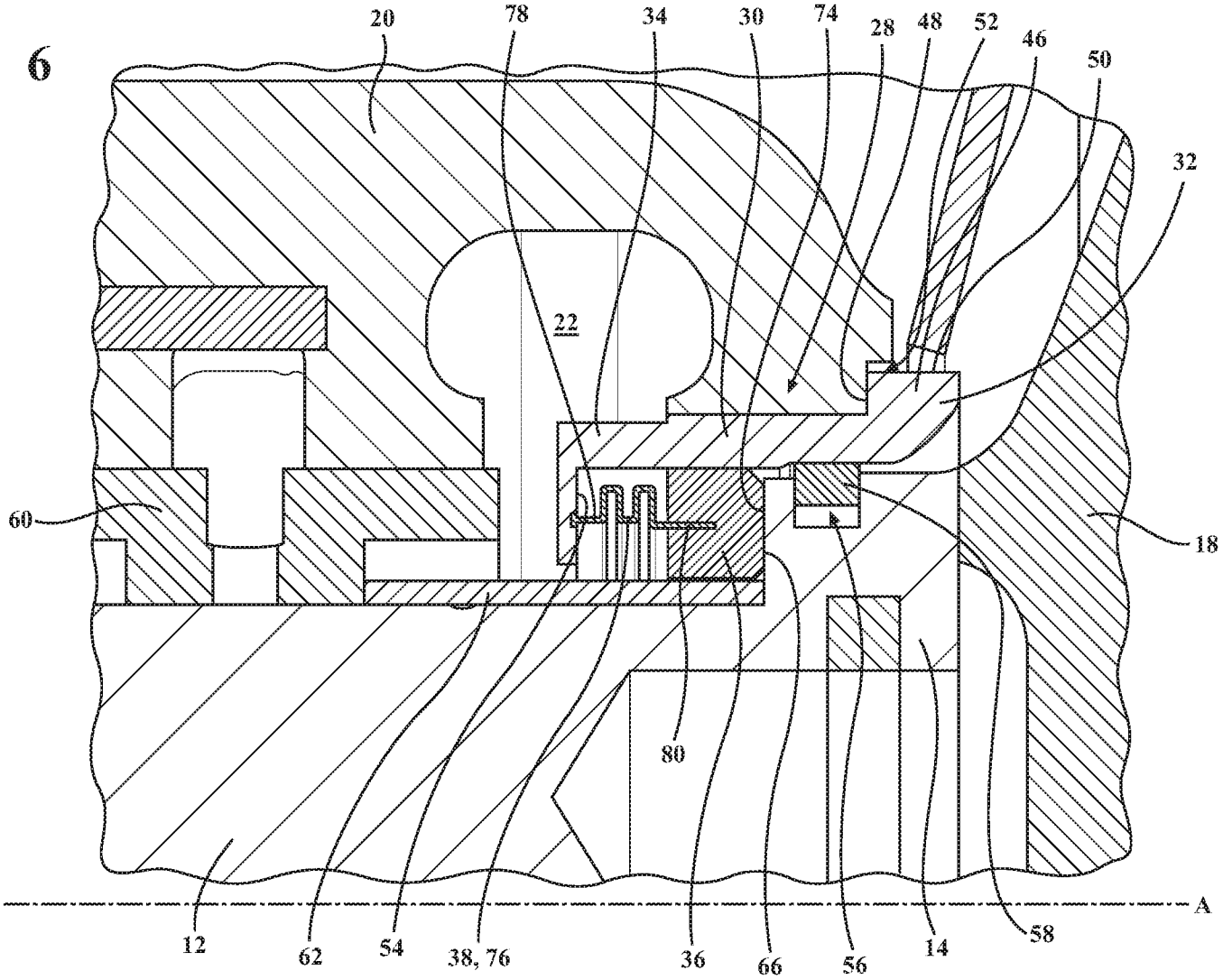
FIG. 6 is a cross-sectional view of the turbocharger, with the second case end of the case extending radially inward toward the shaft and presenting a coupling surface to which the deformable component is coupled.
Figure 7:
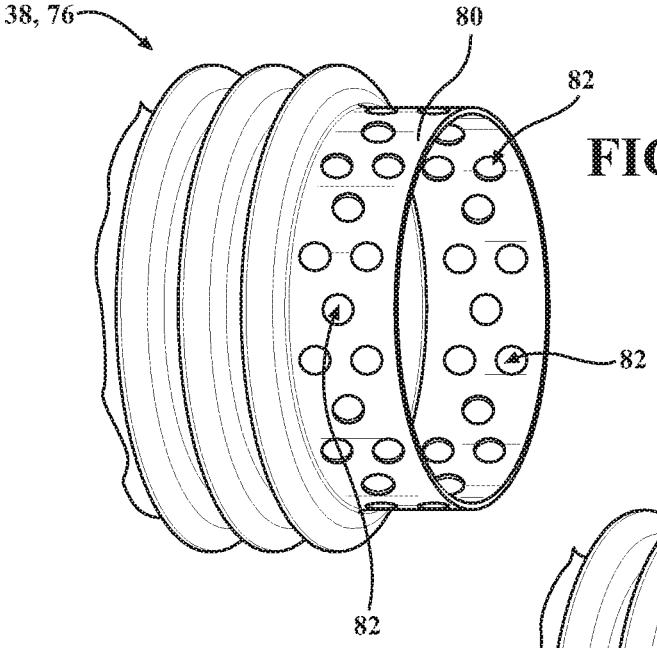
FIG. 7 is a perspective view of the second bellow end of the bellow, with the second bellow end of the bellow defining a plurality of holes.
Figure 8:
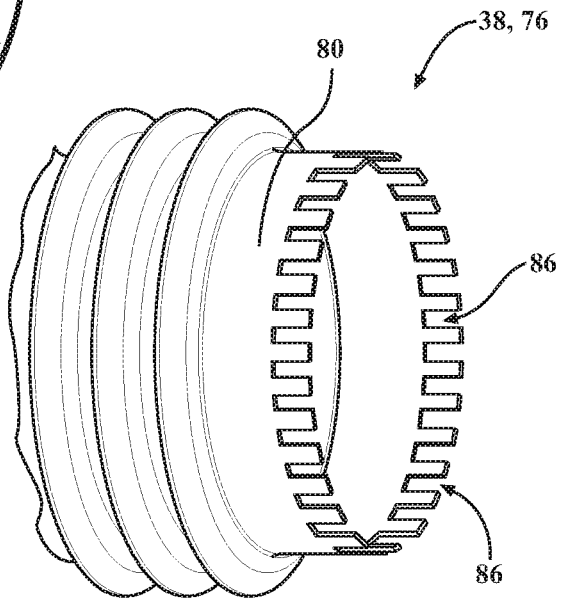
FIG. 8 is a perspective view of the second bellow end of the bellow, with the second bellow end of the bellow defining a plurality of notches.

In some embodiments, as shown in FIGS. 2, 3, and 6, the second case end 34 of the case 30 extends radially inward toward the shaft 12. The second case end 34 of the case 30 may extend radially inward toward the shaft 12 and present a coupling surface 54 to which the deformable component 38 may couple. In the embodiments where the deformable component 38 is configured to bias the ring 36 toward the turbine wheel 18, the first force may be exerted against the second case end 34 of the case 30 that extends radially inward toward the shaft 12. The second case end 34 of the case 30 may also assist in limiting the exhaust gas from contacting the deformable component 38, thus acting as a shield against the exhaust gas and extending the life, durability, and reliability of the deformable component 38. More specifically, any exhaust gas that leaks into the bearing housing interior 22 may be limited in contacting the deformable component 38 by the second case end 34 of the case 30 partially surrounding the deformable component 38. In the embodiments where the second case end 34 of the case 30 extends radially inward toward the shaft 12, the case 30 in cross-section is generally L-shaped or generally Z-shaped.

Figure 4:
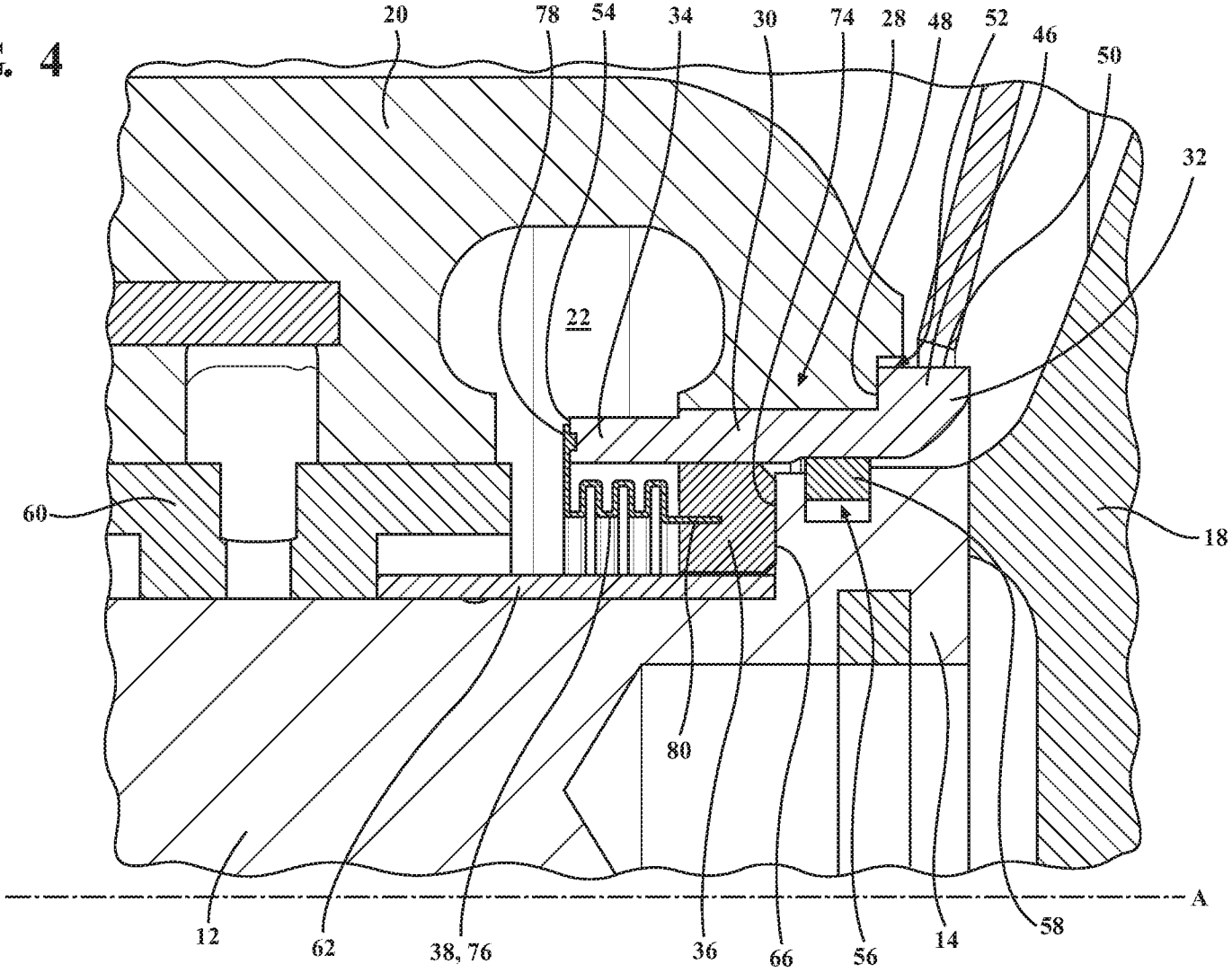
FIG. 4 is a cross-sectional view of the turbocharger, with the sealing assembly including a bellow having a first bellow end extending radially away from the shaft and fixedly coupled to the second case end of the case, and having a second bellow end fixedly coupled to the ring to allow the bellow to be moveable with the ring.
Figure 5:
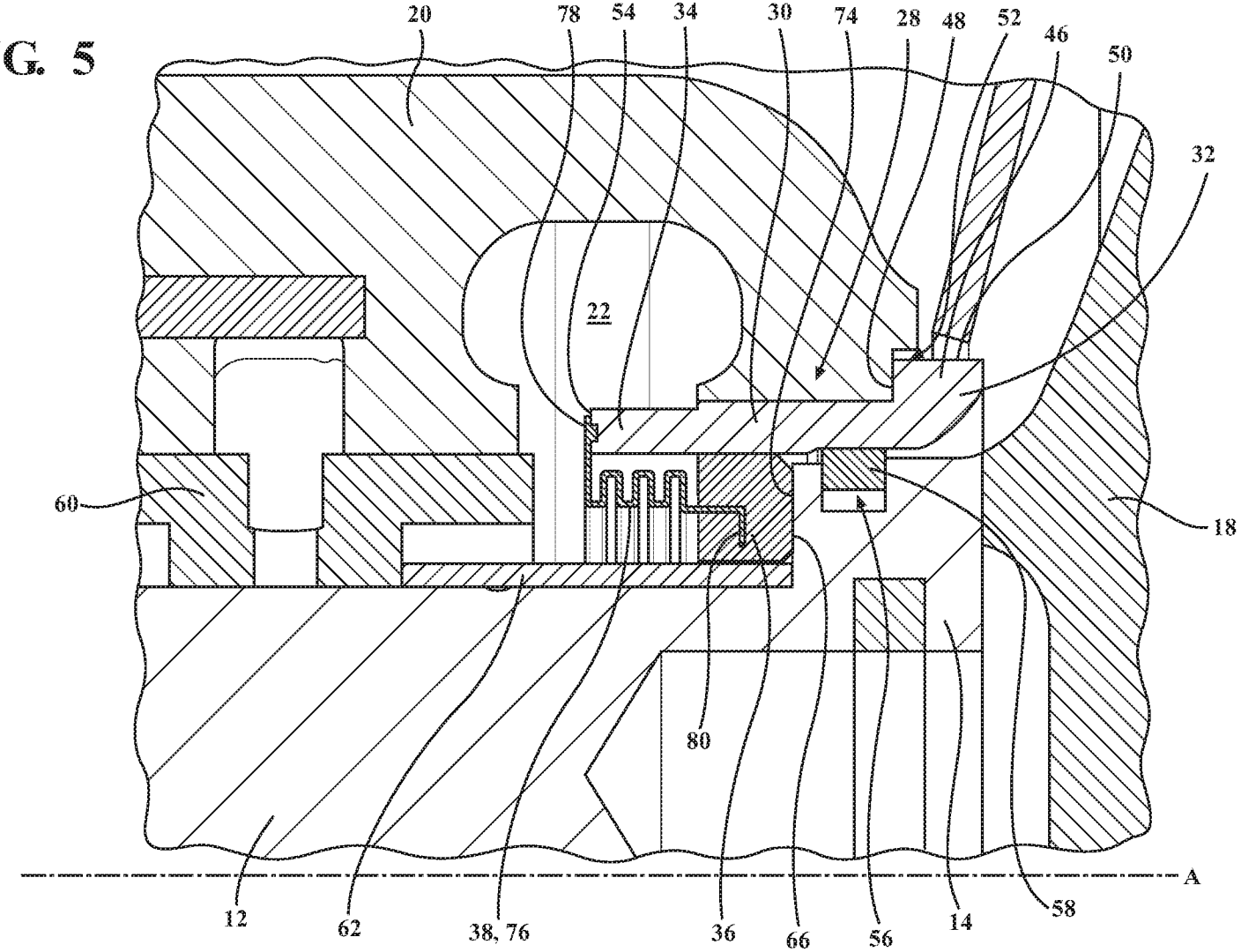
FIG. 5 is a cross-sectional view of the turbocharger, with the sealing assembly including the second bellow end of the bellow extending radially inward toward the shaft.

Alternatively, as shown in FIGS. 4 and 5, the second case end 34 of the case 30 may extend axially away from the turbine wheel 18. In these embodiments, the case 30 may still have the coupling surface 54 to which the deformable component 38 may couple. The coupling surface 54 may extend radially away from the axis A and face away from the turbine wheel 18, as shown in FIGS. 4 and 5. Alternatively, the coupling surface 54 may extend axially along the axis A, and either may face the shaft 12 or may face away from the shaft 12.

In some embodiments, the deformable component 38 is disposed between the shaft 12 and the case 30 such that the deformable component 38 is unobstructed by the case 30 radially between the shaft 12 and the deformable component 38. In this embodiment, the case 30 is open or semi-open. In the embodiments where the second case end 34 of the case 30 extends axially away from the turbine wheel 18 and the deformable component 38 is disposed between the shaft 12 and the case 30 such that the deformable component 38 is unobstructed by the case 30 radially between the shaft 12 and the deformable component 38, the case is open. In other words, in these embodiments, the deformable component 38 is enclosed by the case 30 on one of four sides in cross-section when open. In the embodiments where the second case end 34 of the case 30 extends radially inward toward the shaft 12 and the deformable component 38 is disposed between the shaft 12 and the case 30 such that the deformable component 38 is unobstructed by the case 30 radially between the shaft 12 and the deformable component 38, the case 30 is semi-open. In other words, in these embodiments, the deformable component 38 is enclosed by the case 30 on two of four sides in cross-section when semi-open.

Similarly, in the embodiments where the second case end 34 of the case 30 extends axially away from the turbine wheel 18 and the ring 36 is disposed between the shaft 12 and the case 30 such that the ring 36 is unobstructed by the case 30 radially between the shaft 12 and the ring 36, the case is open. In other words, in these embodiments, the ring 36 is enclosed by the case 30 on one of four sides in cross-section when open. In the embodiments where the second case end 34 of the case 30 extends radially inward toward the shaft 12 and the ring 36 is disposed between the shaft 12 and the case 30 such that the ring 36 is unobstructed by the case 30 radially between the shaft 12 and the ring 36, the case 30 is semi-open. In other words, in these embodiments, the ring 36 is enclosed by the case 30 on two of four sides in cross-section when semi-open.

It is to be appreciated that the case 30 may be both semi-open and obstruct the deformable component 38 radially between the shaft 12 and the deformable component 38 without obstructing the ring 36 radially between the shaft 12 and the ring 36.

To further limit blowby of the exhaust gas and leakage of the lubricant, the shaft 12 may define a seating groove 56, and the sealing assembly 28 may further include a piston ring 36 disposed between the case 30 and the shaft 12, and at least partially in the seating groove 56 defined by the shaft 12. The shaft 12 may also define a second seating groove, a third seating groove, or more than three seating grooves into which a second piston ring, a third piston ring, or more than three piston rings may be at least partially disposed in. The piston ring 58 forms a labyrinth seal by defining a tortuous flow path.

It is to be appreciated that the shaft 12 may define the seating groove 56 without having the piston ring 58 being disposed at least partially in the seating groove 56, while still disrupting conduction of heat from the high temperature turbine housing interior 26 through the shaft 12 to the bearing housing interior 22, and also to the lubricant. In the embodiments where the shaft 12 defines the seating groove 56 without having the piston ring 58 being disposed at least partially in the seating groove 56, the seating groove 56 may function as a heat choke to reduce heat flow to the sealing assembly 28.

Although not required, the turbocharger 10 also typically includes a bearing 60 disposed about the shaft 12 for supporting rotation of the shaft 12. The bearing 60 may be, but is not limited to, a journal bearing, a ball bearing, a roller bearing, a semi-floating bushing, or a fully-floating bushing.

In some embodiments, as shown in FIGS. 4-6, the sealing assembly 28 further includes a spacer 62 extending along the axis A, disposed between the deformable component 38 and the shaft 12, and disposed between the ring 36 and the shaft 12. The spacer 62 may also be disposed at least partially between the bearing 60 and the shaft 12. The spacer 62 may prevent contact between the bearing 60 and the sealing assembly 28, thus preventing potential damage to the sealing assembly 28 caused by the contact with the bearing 60 while the bearing 60 is rotating about the axis A. The spacer 62 may comprise a material with low thermal conductivity to limit heat transfer from the shaft 12 to the bearing 60, the bearing housing interior 22, the case 30, the ring 36, and the deformable component 38. Preferably, the spacer 62 may comprise titanium because of the low thermal conductivity of titanium. It is to be appreciated, however, that the spacer 62 may comprise other materials, including, but not limited to, aluminum, steel, iron, lead, copper, brass, bronze, and/or plastics and polymeric materials.

The sealing assembly 28 may further include a sealing member 64 disposed between the ring 36 and the case 30 such that the ring 36 is disposed between the sealing member 64 and the shaft 12. The sealing member 64 may be an o-ring, a gasket, a lip seal, a flip seal, a quad ring, an x-ring, a tubular ring, a c-ring, packing, and/or any elastomeric or metal material that my form a fluid-tight barrier between the ring 36 and the case 30 while being moveable with the ring 36 to seal the bearing housing interior 22 and the turbine housing interior 26. It is also to be appreciated that the sealing assembly 28 may include two or more sealing members 64 disposed between the ring 36 and the case 30. Although not limiting, the sealing member 64 may comprise perfluoroelastomers, fluorocarbons, and/or silicones. The arrangement of components in the sealing assembly 28 prevents the sealing assembly from reaching temperatures high enough to cause failure of the sealing member 64.

The ring 36 may present a first sealing surface 66 facing the turbine wheel 18. The first sealing surface 66 may be flat. In one embodiment, as shown in FIG. 2, the sealing assembly may further include an isolator 68 coupled to the shaft 12, and the isolator 68 may present a second sealing surface 70 contactable with the first sealing surface 66 of the ring 36 to seal the bearing housing interior 22 and the turbine housing interior 26. It is to be appreciated that the isolator 68 may be relatively thin in cross-section to limit transfer of heat from the shaft 12 to the isolator 68. It is also to be appreciated that the second sealing surface 70 may be flat.

Because the ring 36 is moveable with the deformable component 38, the first sealing surface 66 of the ring 36 may contact the second sealing surface 70 of the isolator 68. More specifically, before operation of the turbocharger 10, the first sealing surface 66 of the ring 36 is in contact with the second sealing surface 70 of the isolator 68. During operation of the turbocharger 10, a film pressure is generated between the first sealing surface 66 of the ring 36 and the second sealing surface 70 of the isolator 68.

The film pressure pushes against the first sealing surface 66 of the ring 36, and thus against the deformable component 38, to move the first sealing surface 66 of the ring 36 away from the second sealing surface 70 of the isolator 68 to form a gap therebetween. Said differently, during operation of the turbocharger 10, the ring 36 may lift off the isolator 68. The film pressure present in the gap is a barrier against blowby of the exhaust gas and leakage of the lubricant, and thus maintains sealing while reducing power friction losses. The film pressure generated in the gap between the first sealing surface 66 of the ring 36 and the second sealing surface 70 of the isolator 68 generally makes the sealing assembly 28 a non-contacting face seal, as referred to in the art.

The isolator 68 and the shaft 12 may together define an insulating cavity 72 therebetween to further seal the bearing housing interior 22 and the turbine housing interior 26. The insulating cavity 72 disrupts conduction of heat from the high temperature turbine housing interior 26 through the shaft 12 to the bearing housing interior 22, and thus also to the lubricant. The isolator 68 and the insulating cavity 72 may also both prevent the temperature of the sealing member 64 from increasing to the point of failure of the sealing member 64. More specifically, the isolator 68 and the insulating cavity 72 may prevent the sealing member 64 from being fixed in compression, due to thermal degradation and/or loss of elasticity, during thermal soak back of the high temperatures (e.g. about 400 degrees centigrade) present and stored in the turbine housing interior 26 after operation of the turbocharger 10 and the internal combustion engine.

The isolator 68 may comprise a material with low thermal conductivity to limit heat transfer from the shaft 12 to the bearing 60, the bearing housing interior 22, the case 30, the ring 36, and the deformable component 38. Preferably, the isolator 68 may comprise titanium because of the exceptionally low thermal conductivity of titanium. It is to be appreciated, however, that the isolator 68 may comprise other materials, including, but not limited to, aluminum, steel, iron, lead, copper, brass, bronze, and/or plastics and polymeric materials.

The isolator 68 in cross-section may be generally L-shaped or generally Z-shaped. The isolator 68 may also be fixedly coupled to the shaft 12. Although not required, the isolator 68 may be laser welded to, resistance welded to, spot welded to, brazed to, soldered to, mechanically affixed to, press fit with, and/or cast integrally with the shaft 12 to be fixedly coupled to the shaft 12. The isolator 68, thus, may be rotationally coupled with the shaft 12 such that the isolator 68 rotates with the shaft 12. The isolator 68 may also define pressure-generating grooves for generating the film pressure between the first sealing surface 66 of the ring 36 and the second sealing surface 70 of the isolator 68 when the shaft 12 is rotating. Particularly, the pressure-generating grooves may be spiraled.

In another embodiment, as shown in FIGS. 3-6, the shaft 12 presents a third sealing surface 74 contactable with the first sealing surface 66 of the ring 36 to seal the bearing housing interior 22 and the turbine housing interior 26. It is to be appreciated that the third sealing surface 74 may be flat. Because the ring 36 is moveable with the deformable component 38, the first sealing surface 66 of the ring 36 may contact the third sealing surface 74 of the shaft 12. More specifically, before operation of the turbocharger 10, the first sealing surface 66 of the ring 36 is in contact with the third sealing surface 74 of the shaft 12. During operation of the turbocharger 10, the film pressure is generated between the first sealing surface 66 of the ring 36 and the third sealing surface 74 of the shaft 12. The film pressure pushes against the first sealing surface 66 of the ring 36, and thus against the deformable component 38, to move the first sealing surface 66 of the ring 36 away from the third sealing surface 74 of the shaft 12 to form a gap therebetween. Said differently, during operation of the turbocharger 10, the ring 36 may lift off the shaft 12. The film pressure present in the gap is a barrier against blowby of the exhaust gas and leakage of the lubricant, and thus maintains sealing while reducing power friction losses. The film pressure generated in the gap between the first sealing surface 66 of the ring 36 and the third sealing surface 74 of the shaft 12 generally makes the sealing assembly 28 a non-contacting face seal.

In other embodiments, as shown in FIGS. 4-6, the deformable component 38 is a bellow 76 having a corrugated configuration. The bellow 76 may expand and contract with the movement of the ring 36. It is to be appreciated that the bellow 76 may also be configured to bias the ring 36 toward the turbine wheel 18. The bellow 76 may exert a first force against the second case end 34 of the case 30, and the first force may be exerted away from the turbine wheel 18. However, in the embodiments where the first force is exerted against the second case end 34 of the case 30 and the case 30 has the lip 46, the lip 46 of the case 30 may prevent the second case end 34 of the case 30 from moving axially away from the turbine wheel 18. In these embodiments, therefore, the second case end 34 of the case 30 is static, and the bellow 76 may exert a second force against the ring 36 to bias the ring 36 toward the turbine wheel 18.

In some embodiments, as shown in FIG. 6, the second case end 34 of the case 30 extends radially inward toward the shaft 12. In the embodiments where the bellow 76 is configured to bias the ring 36 toward the turbine wheel 18, the first force is exerted against the second case end 34 of the case 30 that extends radially inward toward the shaft 12. The second case end 34 of the case 30 may also assist in limiting the exhaust gas from contacting the bellow 76, thus acting as a shield against the exhaust gas and extending the life, durability, and reliability of the bellow 76. More specifically, any exhaust gas that leaks into the bearing housing interior 22 may be limited in contacting the deformable component 38 by the second case end 34 of the case 30 partially surrounding the deformable component 38.

The bellow 76 may have a first bellow end 78 extending radially away from the shaft 12 and fixedly coupled to the second case end 34 of the case 30. Although not required, the first bellow end 78 of the bellow 76 may be laser welded to, resistance welded to, spot welded to, brazed to, soldered to, mechanically affixed to, press fit with, and/or cast integrally with the second case end 34 of the case 30 to be fixedly coupled to the second case end 34 of the case 30.

The bellow 76 also has a second bellow end 80 opposite the first bellow end 78. It is to be appreciated that the first and second bellow ends 78, 80 need not be the exact terminuses of the bellow 76. The second bellow end 80 of the bellow 76 may be fixedly coupled to the ring 36 to allow the bellow 76 to be moveable with the ring 36. In some embodiments, as shown in FIGS. 4-6, the second bellow end 80 of the bellow 76 is encompassed by the ring 36. The ring 36 may comprise carbon, silicon nitride, ceramics, aluminum, steel, iron, lead, copper, brass, bronze, and/or plastics and polymeric materials. Although not limiting, the ring 36 may be molded onto the second bellow end 80 of the bellow 76, or the ring 36 may be sintered onto the second bellow end 80 of the bellow 76.

In some embodiments, the second bellow end 80 of the bellow 76 extends along the axis A toward the turbine wheel 18. In this embodiment, as shown in FIGS. 4 and 6, the second bellow end 80 of the bellow 76 may be encompassed by the ring 36 such that only a portion of the bellow 76 that extends along the axis A is encompassed by the ring 36. It is to be appreciated that the second bellow end 80 need not be the exact terminus of the bellow 76.

Alternatively, in other embodiments, the second bellow end 80 extends either radially inward toward the shaft 12, as shown in FIG. 5, or radially outward away from the shaft 12. In the embodiments where the second bellow end 80 of the bellow 76 is encompassed by the ring 36, the second bellow end 80 of the bellow 76 may be angled relative to where the bellow 76 begins to be encompassed by the ring 36. Angling the second bellow end 80 of the bellow 76 relative to where the bellow 76 begins to be encompassed by the ring 36 increases the strength at which the bellow 76 is coupled to the ring 36. In other words, angling the second bellow end 80 of the bellow 76 relative to where the bellow 76 begins to be encompassed by the ring 36 prevents the second bellow end 80 of the bellow 76 from being removed (e.g. pulled out) from the ring 36 during operation of the turbocharger 10 or when the ring 36 moves with the bellow 76.

Figure 9A:
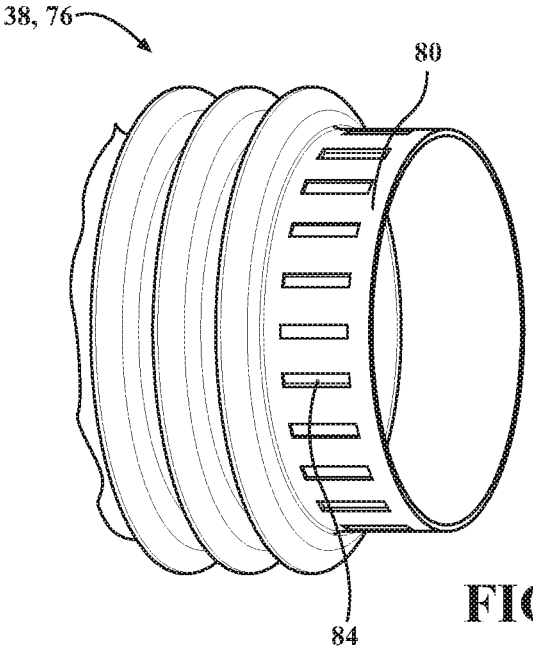
FIG. 9A is a perspective view of the second bellow end of the bellow, with an outer surface of the second bellow end of the bellow defining a plurality of grooves.
Figure 9B:
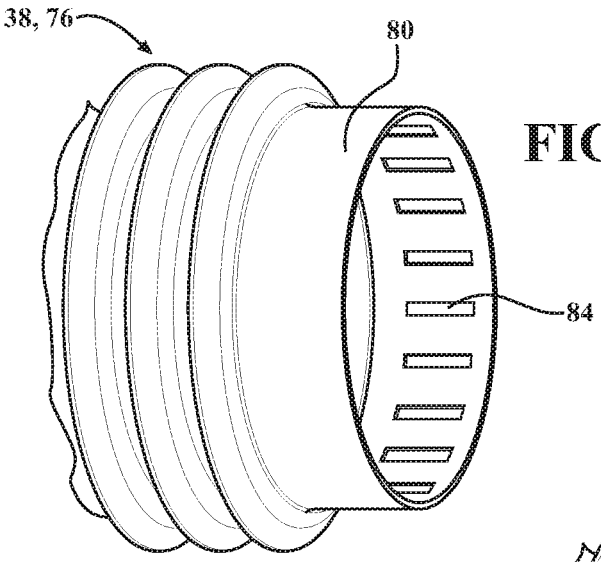
FIG. 9B is a perspective view of the second bellow end of the bellow, with an inner surface of the second bellow end of the bellow defining the plurality of grooves.

The second bellow end 80 may define at least one of a plurality of holes 82, grooves 84, and notches 86, encompassed by the ring 36, as shown in FIGS. 7-9B. The plurality of holes 82, plurality of grooves 84, and/or plurality of notches 86 that may be defined by the ring 36 increase the strength at which the bellow 76 is coupled to the ring 36. In other words, the plurality of holes 82, plurality of grooves 84, and/or plurality of notches 86 that may be defined by the second bellow end 80 further prevents the second bellow end 80 of the bellow 76 from being removed (e.g. pulled out) from the ring 36 during operation of the turbocharger 10, or when the ring 36 moves with the bellow 76. It is to be appreciated that the plurality of grooves 84 may be defined on an outer surface of the second bellow end 80, as shown in FIG. 9A, may be defined on an inner surface of the second bellow end 80, as shown in FIG. 9B, or may be defined on both the inner and outer surfaces of the second bellow end 80.

Figure 10:
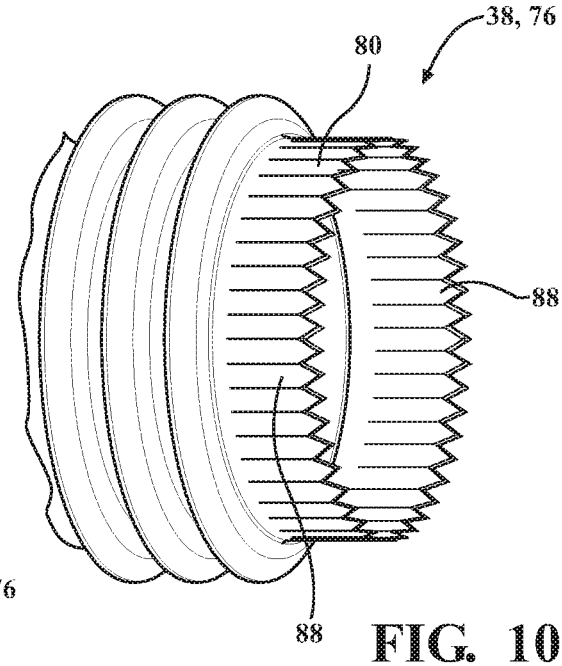
FIG. 10 is a perspective view of the second bellow end of the bellow, with the second bellow end of the bellow shaped to have a plurality of corrugations.
Figure 11:
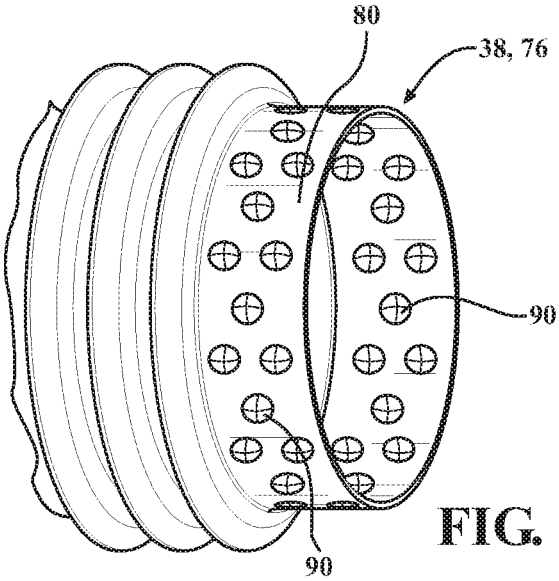
FIG. 11 is a perspective view of the second bellow end of the bellow, with the second bellow end of the bellow shaped to have a plurality of protrusions.

Moreover, the second bellow end 80 may be shaped to have a plurality of corrugations 88 and/or a plurality of protrusions 90, encompassed by the ring 36, as shown in FIGS. 10 and 11, respectively. The plurality of corrugations 88 and/or the plurality of protrusions 90 that may be shaped with the second bellow end 80 increase the strength at which the bellow 76 is coupled to the ring 36. In other words, the plurality of corrugations 88 and/or the plurality of protrusions 90 that may be shaped with the second bellow end 80 further prevents the second bellow end 80 of the bellow 76 from being removed (e.g. pulled out) from the ring 36 during operation of the turbocharger 10, or when the ring 36 moves with the bellow 76.

It is to be appreciated that either the case 30, the ring 36, or both the case 30 and the ring 36 may include an anti-rotation feature to prevent rotation of either the case 30, the ring 36, or both the case 30 and the ring 36 relative to the bearing housing 20.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A turbocharger for delivering compressed air to an internal combustion engine, said turbocharger comprising:

a shaft extending along an axis between a first shaft end and a second shaft end;

a turbine wheel coupled to said first shaft end of said shaft;

a bearing housing disposed about said shaft and defining a bearing housing interior;

a turbine housing disposed about said turbine wheel and defining a turbine housing interior; and a sealing assembly for sealing said bearing housing interior and said turbine housing interior, said sealing assembly comprising;

a case disposed about said shaft and extending along said axis between a first case end proximate to said turbine wheel and a second case end distal from said turbine wheel;

a ring disposed between said shaft and said case such that said ring is unobstructed by said case radially between said shaft and said ring, wherein said ring presents a first sealing surface facing said turbine wheel;

a deformable component coupled to said second case end of said case and to said ring, and moveable with said ring to seal said bearing housing interior and said turbine housing interior; and an isolator coupled to said shaft and presenting a second sealing surface contactable with said first sealing surface of said ring to seal said bearing housing interior and said turbine housing interior, wherein said isolator and said shaft together define an insulating cavity therebetween to further seal said bearing housing interior and said turbine housing interior.

2. The turbocharger as set forth in claim 1, wherein said case at said first case end has a lip extending radially away from said axis and directly coupled to said bearing housing to prevent said case from moving axially away from said turbine wheel.

3. The turbocharger as set forth in claim 1, wherein said deformable component is configured to bias said ring toward said turbine wheel.

4. The turbocharger as set forth in claim 1, wherein said second case end of said case extends radially inward toward said shaft.

5. The turbocharger as set forth in claim 1, wherein said deformable component is disposed between said shaft and said case such that said deformable component is unobstructed by said case radially between said shaft and said deformable component.

6. The turbocharger as set forth in claim 1, wherein said shaft defines a seating groove, wherein said sealing assembly further comprises a piston ring disposed between said case and said shaft, and at least partially in said seating groove.

7. The turbocharger as set forth in claim 1, wherein said sealing assembly further comprises a sealing member disposed between said ring and said case such that said ring is disposed between said sealing member and said shaft.

8. The turbocharger as set forth in claim 1, wherein said isolator comprises titanium.

9. The turbocharger as set forth in claim 1, wherein said isolator is fixedly coupled to said shaft.

10. The turbocharger as set forth in claim 1, wherein said first sealing surface of said ring is flat.

11. The turbocharger as set forth in claim 1, wherein said second sealing surface of said isolator is flat.

12. The turbocharger as set forth in claim 1, wherein said first sealing surface of said ring is moveable away from said second sealing surface of said isolator to form a gap therebetween.

13. The turbocharger as set forth in claim 12, wherein said first sealing surface of said ring and said second sealing surface of said isolator are together configured to generate a film pressure in said gap to act as a barrier against blowby of exhaust gas.

14. The turbocharger as set forth in claim 13, wherein said isolator defines pressure-generating grooves for generating said film pressure between said first sealing surface of said ring and said second sealing surface of said isolator.

15. The turbocharger as set forth in claim 14, wherein said pressure-generating grooves are spiraled.

16. The turbocharger as set forth in claim 1, wherein said isolator is rotationally coupled with said shaft such that said isolator rotates with said shaft.

17. The turbocharger as set forth in claim 1, wherein said sealing assembly is a non-contacting face seal.

18. The turbocharger as set forth in claim 1, wherein said insulating cavity is configured to limit transfer of heat from said turbine housing interior to said bearing housing interior.

19. The turbocharger as set forth in claim 18, wherein said insulating cavity is configured to limit conduction of heat from said turbine housing interior through said shaft to said bearing housing interior.

20. The turbocharger as set forth in claim 7, wherein said insulating cavity is configured to prevent said sealing member from being fixed in compression.

* * * * *